US009793033B2

(12) United States Patent
Fukao

(10) Patent No.: US 9,793,033 B2
(45) Date of Patent: Oct. 17, 2017

(54) RESISTOR AND MANUFACTURING METHOD

(71) Applicant: KOA Corporation, Nagano (JP)

(72) Inventor: Hiroyuki Fukao, Nanao (JP)

(73) Assignee: KOA Corporation, Nagano (JP)

( * ) Notice: Subject to any disclaimer, the term of this patent is extended or adjusted under 35 U.S.C. 154(b) by 76 days.

(21) Appl. No.: 14/920,999

(22) Filed: Oct. 23, 2015

(65) Prior Publication Data

US 2016/0118164 A1 Apr. 28, 2016

(30) Foreign Application Priority Data

Oct. 24, 2014 (JP) ..... 2014-217820

(51) Int. Cl.

| | |
|---|---|
| ***H01C 3/10*** | (2006.01) |
| ***H01C 1/14*** | (2006.01) |
| ***H01C 17/242*** | (2006.01) |
| ***H01C 3/12*** | (2006.01) |
| ***H01C 7/10*** | (2006.01) |
| ***H01C 17/065*** | (2006.01) |
| ***H01C 17/245*** | (2006.01) |

(52) U.S. Cl.

CPC ..... *H01C 1/14* (2013.01); *H01C 3/12* (2013.01); *H01C 7/1006* (2013.01); *H01C 17/065* (2013.01); *H01C 17/242* (2013.01); *H01C 17/245* (2013.01)

(58) Field of Classification Search

CPC ..... H01C 1/14; H01C 17/242; H01C 17/245; H01C 1/012

USPC ..... 338/287, 195

See application file for complete search history.

(56) References Cited

U.S. PATENT DOCUMENTS

| | | | | |
|---|---|---|---|---|
| 3,512,254 A * | 5/1970 | Tarcza | H01C 1/024 | 174/564 |
| 4,375,056 A * | 2/1983 | Baxter | G01K 7/183 | 338/195 |
| 4,777,826 A * | 10/1988 | Rud, Jr. | G01L 1/2281 | 338/195 |
| 4,859,981 A * | 8/1989 | Peschl | H01C 7/22 | 338/195 |
| 5,929,746 A * | 7/1999 | Edwards, Jr. | H01C 1/14 | 338/203 |

(Continued)

FOREIGN PATENT DOCUMENTS

JP 2004200424 7/2004

*Primary Examiner* — Kyung Lee

(74) *Attorney, Agent, or Firm* — Edell, Shapiro & Finnan LLC

(57) ABSTRACT

There is provided a resistor in which a first resistive part of a resistive element that electrically conducts between a pair of electrodes formed on either end of an insulating substrate has a meandering pattern meandering on the substrate surface and a swelling pattern that has a form in which a part of the meandering pattern swells out from the stroke width of the meandering pattern, a second resistive part that is electrically connected in series to the first resistive part is shorter than the entire length of the first resistive part, and has a wider width than the stroke width of the meandering pattern, and a trimming groove is formed in at least either the swelling pattern or the second resistive part. This can improve resistance accuracy and provide a high voltage resistor with high withstand voltage property.

6 Claims, 6 Drawing Sheets

(56) References Cited

U.S. PATENT DOCUMENTS

| | | | | |
|---|---|---|---|---|
| 6,084,502 | A * | 7/2000 | Ariga | H01C 17/06 338/195 |
| 6,292,091 | B1 * | 9/2001 | Kambara | H01C 7/00 29/620 |
| 6,529,116 | B2 * | 3/2003 | Van Den Broek | H01C 17/242 338/195 |
| 7,079,004 | B2 * | 7/2006 | Budak | G01R 15/06 338/195 |
| 7,286,039 | B2 * | 10/2007 | Yoneda | H01C 3/12 338/195 |
| 7,439,846 | B2 * | 10/2008 | Nakayama | H01C 17/242 219/121.69 |

* cited by examiner

RESISTOR AND MANUFACTURING METHOD

TECHNICAL FIELD

The present invention relates to voltage resistors, and in particular, a high withstand voltage resistor and a manufacturing method for the same.

BACKGROUND

Conventionally, high voltage resistors have been used in the vicinity of power supplies for household appliances etc. High voltage resistors typically have been designed to have a resistance of 1 MΩ or greater and to withstand a voltage of 1 kV or greater. With such a high voltage resistor, while it is necessary to improve resistance accuracy and withstand voltage, efficiently raising the resistance accuracy is difficult due to the high resistance.

Technologies for increasing resistance accuracy of a resistor are disclosed in, for example, JP 2004-200424A, which discloses techniques for increasing resistance accuracy of a chip resistor. More specifically, multiple thick-film resistive elements having different sheet resistances are formed between a pair of electrodes, and laser trimming is performed to the respective thick-film resistive elements so as to provide a desired resistance. This resistance adjustment method serially connects the multiple resistive elements having different resistances and performs trimming to the resistive element, in order beginning with the element with the largest resistance (thick-film resistive element having the largest sheet resistance) so as to adjust the resistances. As a result, this technique not only makes the manufacturing process complicated due to formation of multiple thick-film resistive elements having different sheet resistances, but also, the resistance adjusting process is also complicated, contributing to the rising cost of manufacturing the resistor itself.

SUMMARY

The present invention provides a high voltage resistor capable of improving resistance accuracy while maintaining a high withstand voltage property. A manufacturing method for the same is also provided.

The following configuration, for example, is provided as a means for reaching said aim and resolving the above problems. That is, the present invention is a resistor characterized by including a resistive element electrically conducting between a pair of electrodes formed on an insulating substrate. The resistive element has a first resistive part having a meandering pattern and a swelling pattern that is connected to the meandering pattern and has a form in which a part of the meandering pattern swells out from the stroke width of the meandering pattern, and a second resistive part that is shorter than the entire length of the first resistive part, has a wider width than the stroke width of the meandering pattern, and is electrically connected in series to the first resistive part. A trimming groove is formed in at least either the swelling pattern or the second resistive part.

For example, it is characterized by the second resistive part having a linear form. For example, it is characterized in that width of a remaining part of the second resistive part in a region where the trimming groove of the second resistive part is formed is equal to or greater than width of the meandering pattern.

Alternatively, for example, it is characterized by further including an intermediate electrode connecting the first resistive part and the second resistive part. Further alternatively, for example, it is characterized in that the first resistive part and the second resistive part are constituted by the same resistive material.

The following configuration, for example, is provided as another means for resolving the above problems. That is, the present invention is characterized by a manufacturing method for a resistor having a resistive element electrically conducting between a pair of electrodes formed on an insulating substrate. The manufacturing method includes a forming step of forming a first resistive part having a meandering pattern and a swelling pattern that is connected to the meandering pattern and has a form in which a part of the meandering pattern swells out from the stroke width of the meandering pattern, and a second resistive part that is shorter than the entire length of the first resistive part, has a wider width than the stroke width of the meandering pattern, and is electrically connected in series to the first resistive part; a first trimming step of removing a part of the swelling pattern for adjusting resistance so as to elongate a passage of an electric current of the first resistive part; and a second trimming step of narrowing a width of a predetermined region of the second resistive part for adjusting resistance. The width of the remaining part of the predetermined region of the second resistive part where a trimming groove is formed in the second trimming step is equal to or greater than the width of the meandering pattern.

For example, it is characterized in that trimming in the first trimming step is performed through sand blasting, and trimming in the second trimming step is performed using a laser.

According to the present invention, resistance accuracy of a high voltage resistor may be improved and its high withstand voltage property may be maintained.

DETAILED DESCRIPTION

Figure 1:
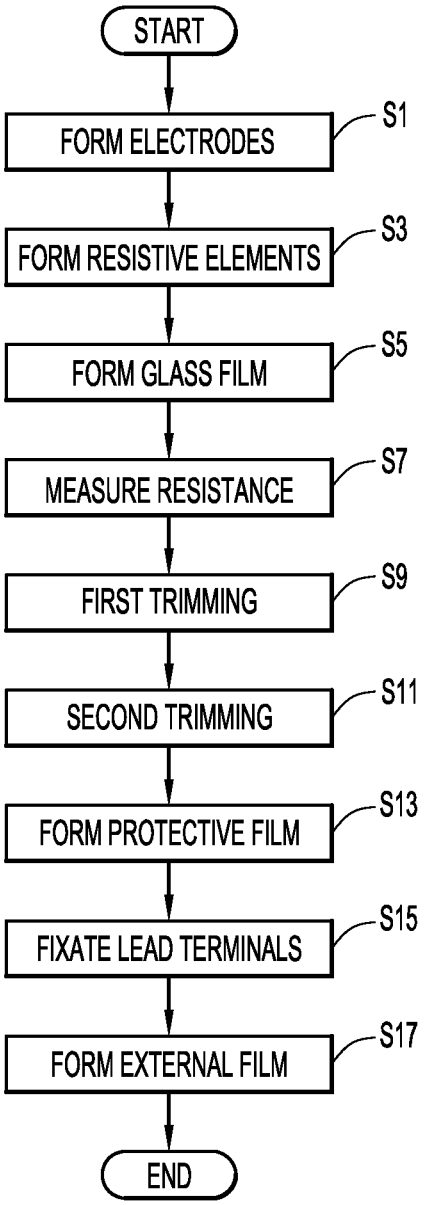
FIG. 1 is a procedural flowchart showing an example of a time series of a manufacturing process of a high voltage resistor in accordance with embodiments of the present invention.
Figure 2:
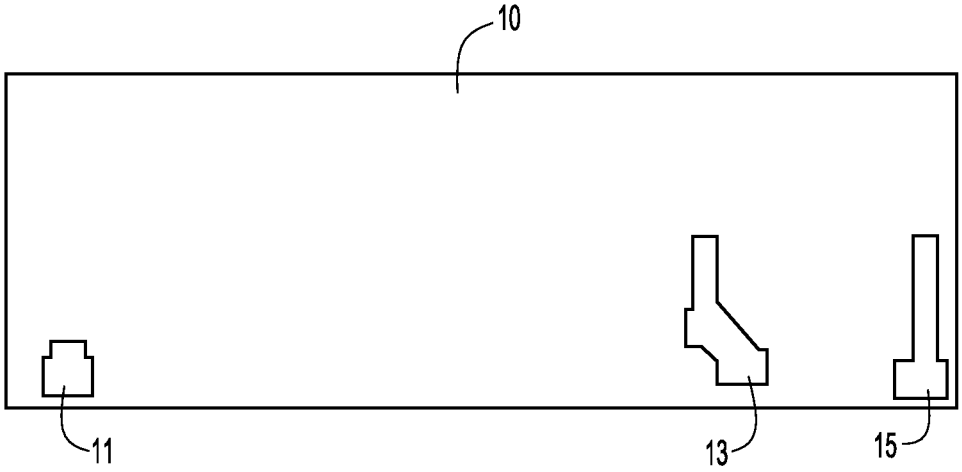
FIG. 2 is a diagram illustrating an example of electrodes formed on an insulating substrate in accordance with embodiments of the present invention.

FIG. 1 is a flowchart showing a time series of a manufacturing process of a high voltage resistor according to embodiments of the present invention. In operation S1 of FIG. 1, electrodes are formed on an insulating substrate. More specifically, as shown in FIG. 2, a first electrode 11, an intermediate electrode 13, and a second electrode 15 having a predetermined form are formed at three different positions on an insulating substrate 10, e.g., an aluminum ceramic substrate. In some embodiments, a silver (Ag)-based paste or silver-palladium (Ag—Pd)-based paste is screen-printed as an electrode material on the substrate and baked, resulting in formation of these electrodes.

Here, the first electrode 11 is arranged at the lower left corner of the insulating substrate 10, the second electrode 15 is arranged at the lower right corner, and the intermediate electrode 13 is arranged on the lower part, slightly to the right from the center. At this time, the position of the lower end of the intermediate electrode 13 is slightly back from, and further on the inner side of the substrate 10 than positions of the first electrode 11 and the second electrode 15. This facilitates forming a protective film described later for covering the intermediate electrode 13, and prevents exposing the intermediate electrode 13 out from the protective film.

Figure 3:
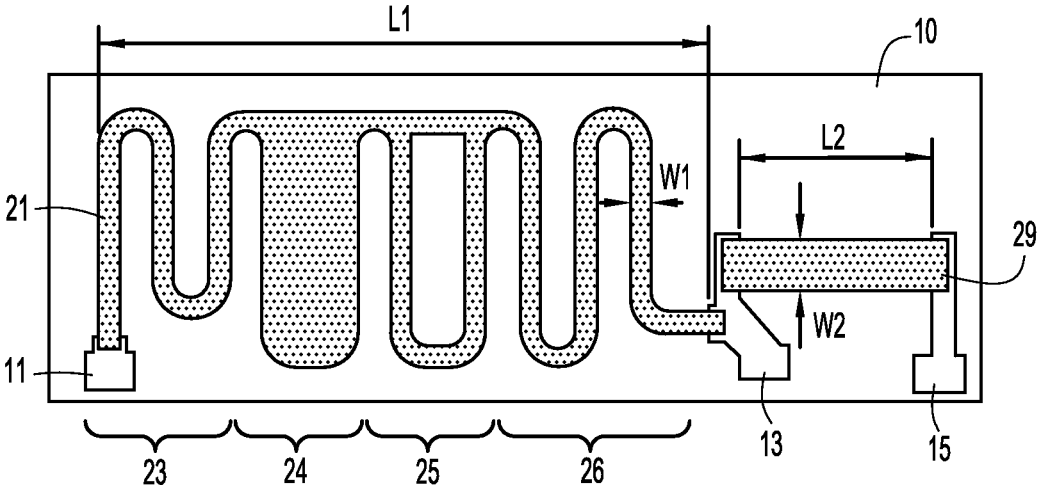
FIG. 3 is a diagram illustrating example resistive elements formed between the electrodes of the resistor in accordance with embodiments of the present invention.

Next, at operation S3, resistive elements are formed between the aforementioned electrodes. Here, as shown in FIG. 3, a first resistive part 21 is formed between the first electrode 11 and the intermediate electrode 13, and a second resistive part 29 is formed between the intermediate electrode 13 and the second electrode 15. The resistive part 21 has a configuration in which resistive elements comprising meandering patterns 23 and 26, a swelling pattern 24 and a coarse adjustment pattern 25 are connected serially. Moreover, the second resistive part 29 comprises a linear (rectangular) resistive element.

The meandering pattern 23 comprises a resistive element having a meandering form on the substrate. One of its ends is connected to the first electrode 11 and the other end is connected to an end of the swelling pattern 24. The number of turns in this meandering pattern 23 may be arbitrarily set. The swelling pattern 24 is constituted by a resistive element having a form swelling out from the stroke width of the meandering pattern. The coarse adjustment pattern 25 has a form swelling out from the stroke width of the meandering pattern like the swelling pattern 24, and also has the form of a pattern turning around made by removal of the resistive element at the central portion into a rectangular or substantially rectangular shape. The swelling pattern 24 and the coarse adjustment pattern 25 are mutually connected on their respective base sides. Moreover, the meandering pattern 26 comprises a resistive element having a meandering form on the substrate and has one end connected to an end of the coarse adjustment pattern 25 and the other end connected to the intermediate electrode 13.

In the high voltage resistor according to an embodiment of the invention, the first resistive part 21 and the second resistive part 29 are formed by screen printing and baking on the substrate, e.g., a ruthenium oxide ($RuO_2$) paste, as a resistive material. That is, the same resistive material is used for the first resistive part 21 and the second resistive part 29. In some embodiments, different resistive materials may be used instead of the same resistive material for the first resistive part 21 and the second resistive part 29. For example, a material having a lower resistance than the material used for the first resistive part 21 may be used as the resistive material for the second resistive part 29.

In other embodiments, the above resistive elements may have a relationship of $L1>L2$ where L1 denotes direct distance between the first electrode 11 and the intermediate electrode 13 of the first resistive part 21, and L2 denotes longitudinal direct distance of the second resistive part 29. Here, L1 may be defined as length of the first resistive part 21 and L2 defined as length of the resistive part 29, where the relationship $L1>L2$ generally holds true in this case as well. Furthermore, in the case where W1 denotes pattern width of the first resistive part 21 and W2 denotes latitudinal width of the second resistive part 29, the resistive elements may be formed so as to satisfy a relationship of $W1<W2$ (e.g., a relationship such that W2 is twice that of W1.)

Figure 4:
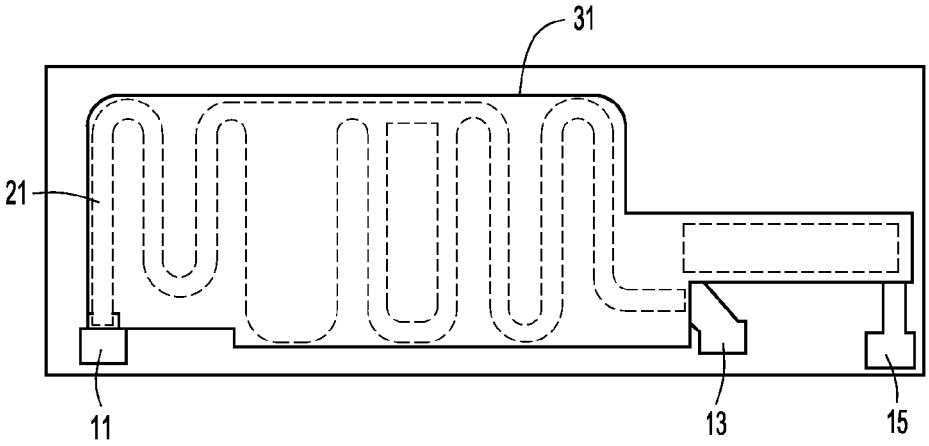
FIG. 4 is a diagram illustrating an example of a glass film covering the resistive elements of the resistor in accordance with embodiments of the present invention.

Next, a glass film is formed in operation S5 of FIG. 1. Here, as indicated by a solid line in FIG. 4, a glass film 31 is formed by screen printing and baking such that, e.g., a glass paste covers the first resistive part 21 and the second resistive part 29 while exposing the first electrode 11, the intermediate electrode 13, and the second electrode 15. This glass film 31 functions as a protective film for the resistive elements and has the effect of suppressing generation of micro cracks made by a laser in a laser trimming step described herein.

At operation S7, resistance is measured. More specifically, probes of a resistance measuring device (e.g., tester) are placed on the first electrode 11 and the intermediate electrode 13 to measure resistance of the first resistive part 21, the probes are then placed on the intermediate electrode 13 and the second electrode 15 so as to measure resistance of the second resistive part 29, and the respective resistance values are then examined to see whether they are within a permissible range.

With the high voltage resistor according to the embodiment, as shown in FIG. 3 etc., the first resistive part 21 (resistance is R1) and the second resistive part 29 (resistance is R2) are arranged in a serially connected manner, where a ratio of R1 to R2 (ratio of conductivity) is, e.g., 1:20.

Figure 5:
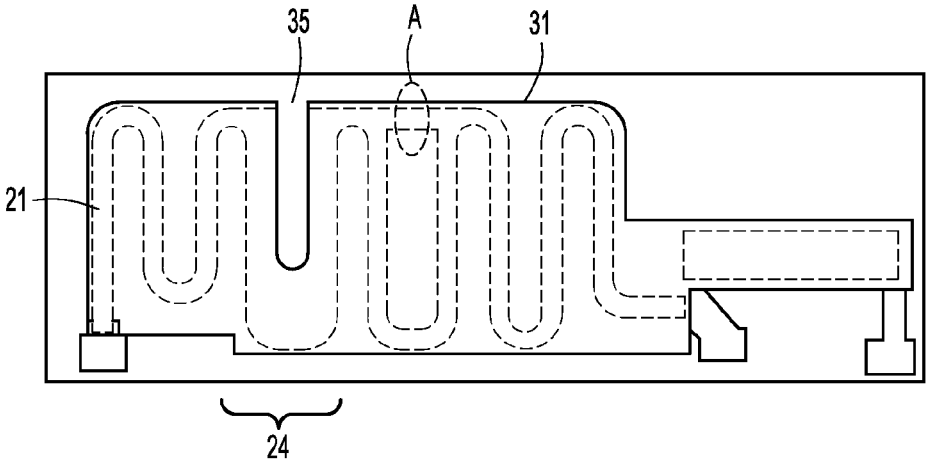
FIG. 5 is a diagram illustrating an example of a trimming groove formed through a first trimming of the resistor in accordance with embodiments of the present invention.

In the next step, trimming of the resistive elements is carried out to adjust the resistance values. That is, in operation S9, a trimming groove (also called a V-cut) 35 is formed in the swelling pattern 24 that constitutes the first resistive part 21 as shown in FIG. 5 by the first trimming. In this case, trimming by sand blasting, e.g., is performed to widen the width of cutting resistive element or to widen the width of the trimming groove 35. In other embodiments, a laser may also be used.

In the first trimming, removal of a part of the resistive elements from the base side of the swelling pattern 24 toward the front end side thereof so as to form the trimming groove 35 allows elongation of the passage of an electric current between the first electrode 11 and the intermediate electrode 13. In this case, an increase in the length of the trimming groove 35 (trim even deeper along the length of the swelling pattern 24) lengthens an alternative route for current running through the swelling pattern 24, thereby allowing adjustment so as to increase the resistance of the first resistive part 21.

In the case of setting the accuracy of a trimming device used in the above trimming process to ±1%, the first trimming trims R1 to fit a nominal resistance (R1+R2)×0.99±1% while measuring R1+R2. Therefore, it results in (R1+R2)×0.98~1.00. Note that severing a part (part A in FIG. 5) of the coarse adjustment pattern 25 allows manufacturing of a series of products e.g., differing in resistance.

Figure 6:
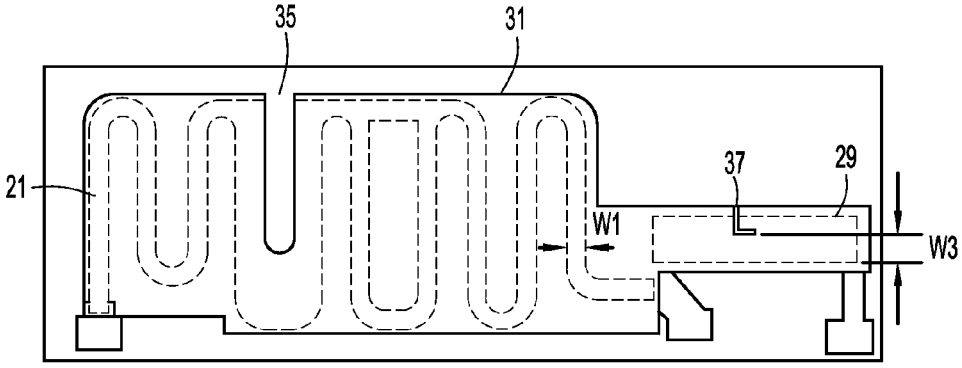
FIG. 6 is a diagram illustrating an example of a trimming groove formed through a second trimming of the resistor in accordance with embodiments of the present invention.

Next, in operation S11, the remaining part after adjustment in the above first trimming operation is adjusted through a second trimming operation. Here, as shown in FIG. 6, a trimming groove (also called an L-cut) 37 is formed at a predetermined position of the second resistive part 29 using, e.g., a laser, to adjust resistance. In this case, while rounded variance in resistance of R2 is ±1%, this variance is ±0.05% for resistance of R1+R2. Therefore, the second trimming allows higher accuracy adjustment than the normal variance of ±1%. Note that if the resistance of R1+R2 is nominal resistance through the first trimming, the second trimming is generally unnecessary.

Supposing that W3 denotes the width of the remaining part in a latitudinal direction (vertical direction in FIG. 6) of the region of the second resistive part 29 in which the L-shaped trimming groove 37 is formed through the second trimming, namely, a distance between the level lower end of the trimming groove 37 and the lower end of the second resistive part 29, and W1 denotes pattern width of the first resistive part 21, there is a relationship: W3≥W1. In the case of W3<W1, there is a possibility that the resistive elements will fuse when a high voltage is applied to the second resistive part 29 whereas in the case of W3≥W1, said fusion can be prevented.

Figure 7:
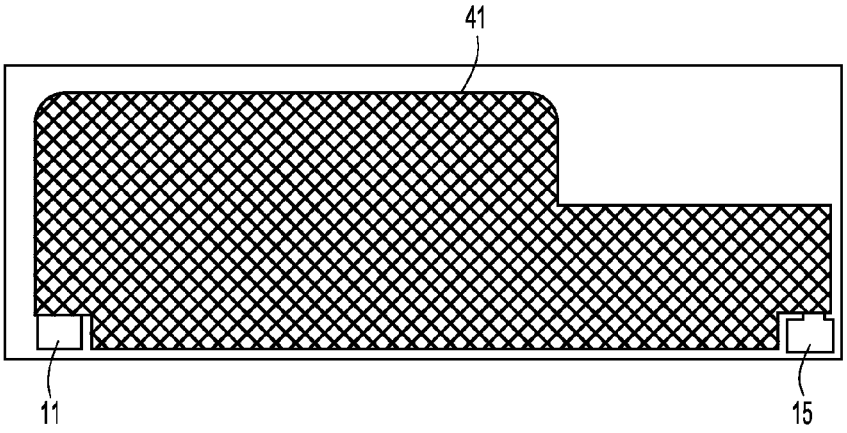
FIG. 7 is a diagram illustrating an example of a protective film formed on the resistor in accordance with embodiments of the present invention.
Figure 8:
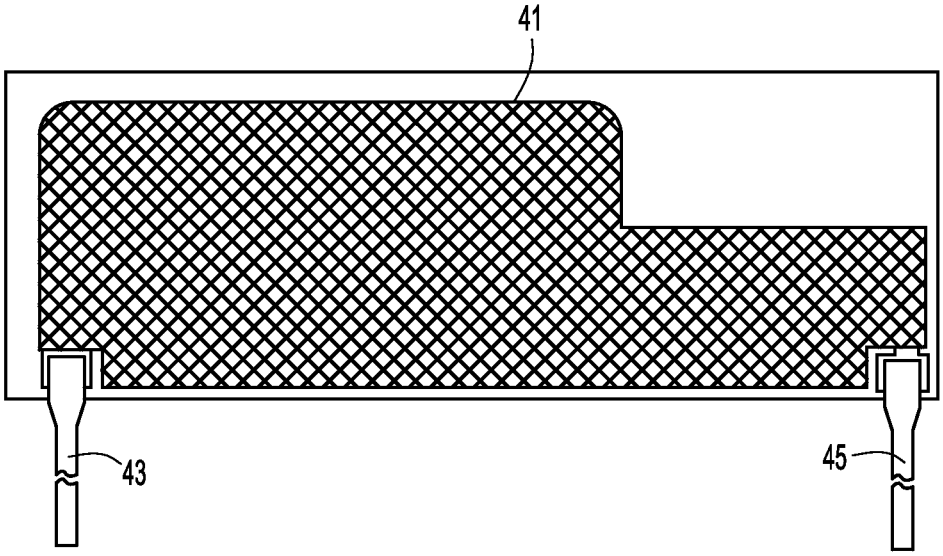
FIG. 8 is a diagram illustrating an example of lead terminals fixed to a first electrode and a second electrode of the resistor, respectively, in accordance with embodiments of the present invention.
Figure 9:
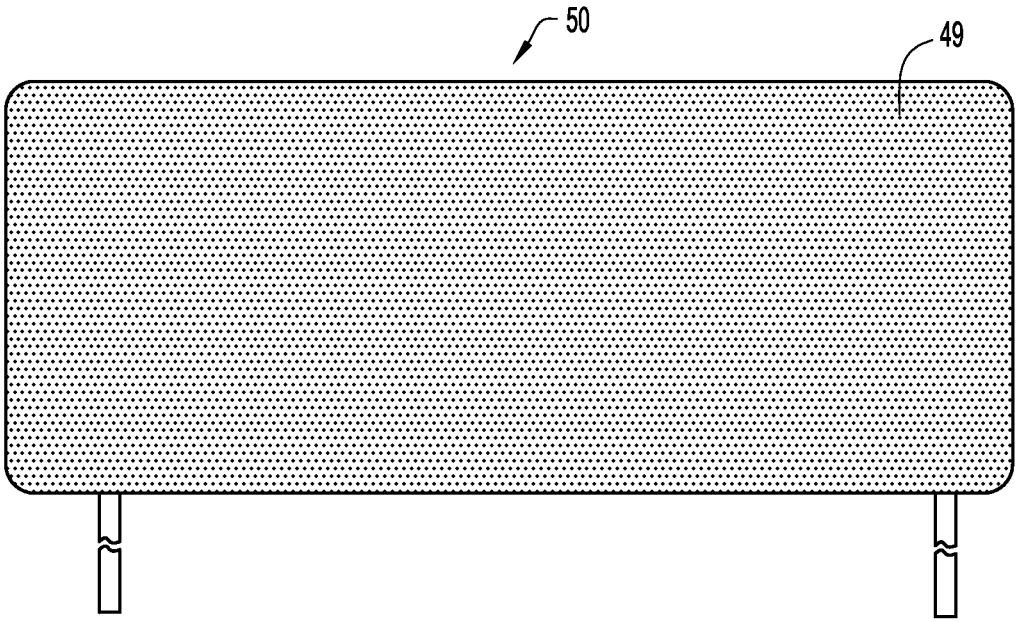
FIG. 9 is a diagram illustrating an example of an exterior film formed on the resistor in accordance with embodiments of the present invention.

In operation S13, as shown in FIG. 7, a protective film 41 is formed such that it completely covers the resistive elements (the first resistive part 21 and the second resistive part 29) including the intermediate electrode 13 except for a part of the first resistive part 21 and the second resistive part 29. This protective film 41 is formed by screen printing an insulating material such as epoxy resin or the like, and hardening by heating. Next, in operation S15, lead terminals 43 and 45 are fixed to the first electrode 11 and the second electrode 15, respectively, by soldering and welding or the like, as shown in FIG. 8. Then, in operation S17, the main portion excluding the lead terminals 43 and 45 is immersed in insulating resin or the like, thereby forming an exterior film 49 as shown in FIG. 9, and then hardening by heating, so as to manufacture a lead wire-type (lead frame independent-type) high voltage resistor 50.

Figure 10:
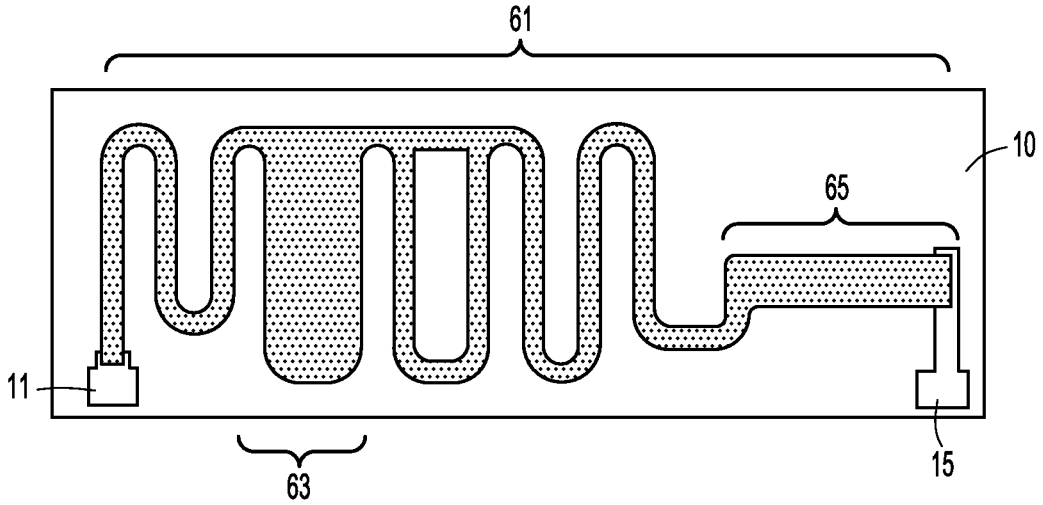
FIG. 10 is a diagram illustrating an example of a modification of the resistor in accordance with embodiments of the present invention.

Note that with the high voltage resistor according to the above embodiment, the three electrodes of the first electrode 11, the intermediate electrode 13 and the second electrode 15 are formed on the insulating substrate 10, yet are not limited thereto. As a modification of the above-given embodiment, for example, a configuration having the two electrodes of the first electrode 11 and the second electrode 15 formed on the insulating substrate 10 without an intermediate electrode may be provided. More specifically, as shown in FIG. 10, a resistive part 61 constituted by a resistive element on which, e.g., a ruthenium oxide (RuO2) paste is screen printed is arranged between the first electrode 11 and the second electrode 15. This resistive part 61 has a form in which the first resistive part 21 and the second resistive part 29 of the high voltage resistor according to the embodiment are connected in series as is.

In the case of the high voltage resistor according to the modification illustrated in FIG. 10, as measurement of resistance, probes of a tester are placed on the first electrode 11 and the second electrode 15 so as to measure whether the resistance of the resistive part 61 is within the permissible range. Based on the measurement results, the resistance is adjusted by forming a trimming groove in one or both of a swelling pattern 63 and a linear resistive part 65.

As described above, the resistor according to this embodiment includes a resistive element constituted by a first resistive part and a second resistive part, where the first resistive part has a meandering pattern that meanders on the surface of an insulating substrate, and a swelling pattern that has a part of the meandering pattern swelling out from the stroke width, and the second resistive part is shorter than the entire length of the first resistive part and has a wider width than the stroke width of the meandering pattern. Moreover, its configuration in which a trimming groove is formed in at least either the swelling pattern or the second resistive part and then the resistance is adjusted allows for improvement in resistance accuracy while maintaining the high withstand voltage property of the high voltage resistor.

Particularly, in the configuration of the L-shaped trimming groove of the second resistive part, as the width of the remaining part of the region in latitudinal direction where the trimming groove is formed is equal to or greater than the pattern width of the first resistive element, fusion of the resistive elements can be reliably prevented even when a high voltage is applied to the second resistive part.

REFERENCE SIGNS LIST

10: Insulating substrate
11: First electrode
13: Intermediate electrode
15: Second electrode
21: First resistive part
23, 26: Meandering pattern
24: Swelling pattern
25: Coarse adjustment pattern
29: Second resistive part
35, 37: Trimming groove
41: Protective film
43, 45: Lead terminal
49: Exterior film
50: High-voltage resistor

The invention claimed is:

1. A resistor, comprising a resistive element electrically conducting between a pair of electrodes formed on an insulating substrate, wherein said resistive element comprises:

a first resistive part having a meandering pattern and a swelling pattern that is connected to the meandering pattern and has a form in which a part of the meandering pattern swells out from a stroke width of the meandering pattern; and a second resistive part that is shorter than an entire length of the first resistive part, has a wider width than the stroke width of the meandering pattern, and is electrically connected in series to the first resistive part, wherein a trimming groove is at least formed in one of the swelling pattern and the second resistive part;

said resistor further comprising:

an intermediate electrode connecting the first resistive part and the second resistive part; and a protective film formed to cover the first resistive part, the second resistive part and the intermediate electrode; and wherein the protective film prevents the intermediate electrode from being externally conducted.

2. The resistor according to claim 1, wherein the second resistive part has a linear form.

3. The resistor according to claim 2, wherein the trimming groove is formed in the second resistive part, and wherein a width of a remaining part of the second resistive part in a region of the second resistive part where the trimming groove is formed is equal to or greater than the stroke width of the meandering pattern.

4. The resistor according to claim 1, wherein the first resistive part and the second resistive part are constituted by a same resistive material.

5. A manufacturing method for a resistor having a resistive element electrically conducting between a pair of electrodes formed on an insulating substrate, said manufacturing method comprising:

forming a first resistive part having a meandering pattern and a swelling pattern that is connected to the meandering pattern and has a form in which a part of the meandering pattern swells out from a stroke width of the meandering pattern, and a second resistive part that is shorter than an entire length of the first resistive part, has a wider width than the stroke width of the meandering pattern, and is electrically connected in series to the first resistive part via an intermediate electrode;

removing a part of the swelling pattern for adjusting resistance so as to elongate a passage of an electric current of the first resistive part;

narrowing a width of a predetermined region of the second resistive part for adjusting resistance, wherein a width of a remaining part of the predetermined region of the second resistive part where a trimming groove is formed is equal to or greater than the stroke width of the meandering pattern; and forming a protective film to cover the first resistive part, the second resistive part and the intermediate electrode, where the protective film prevents the intermediate electrode from being externally conducted.

6. The manufacturing method for a resistor according to claim 5, wherein the removing is performed through sand blasting, and the narrowing is performed using a laser.

* * * * *